US007209700B2

(12) United States Patent
Kubo et al.

(10) Patent No.: US 7,209,700 B2
(45) Date of Patent: Apr. 24, 2007

(54) CLEANING UNIT

(75) Inventors: Takashi Kubo, Kyoto (JP); Hideshi Izumi, Ikoma (JP)

(73) Assignee: Sharp Kabushiki Kaisha, Osaka (JP)

( * ) Notice: Subject to any disclaimer, the term of this patent is extended or adjusted under 35 U.S.C. 154(b) by 116 days.

(21) Appl. No.: 11/062,466

(22) Filed: Feb. 22, 2005

(65) Prior Publication Data

US 2005/0185997 A1 Aug. 25, 2005

(30) Foreign Application Priority Data

Feb. 23, 2004 (JP) ..... 2004-046546

(51) Int. Cl.
*G03G 21/00* (2006.01)
*G03G 21/10* (2006.01)

(52) U.S. Cl. ..... 399/350; 399/71; 399/99; 399/102; 399/345

(58) Field of Classification Search ..... 399/102, 399/350, 351, 349, 343, 358, 345, 71, 98, 399/99; 15/256.5, 356.51, 256.52
See application file for complete search history.

(56) References Cited

U.S. PATENT DOCUMENTS 4,483,606 A * 11/1984 Kuwako et al. ..... 399/105
4,640,608 A * 2/1987 Higaya et al. ..... 399/102
4,905,047 A * 2/1990 Ariyama ..... 399/102
6,128,461 A * 10/2000 Yoshikawa ..... 399/350
6,975,823 B2 * 12/2005 Onishi et al. ..... 399/350
2002/0150406 A1 * 10/2002 Koiso et al. ..... 399/350

FOREIGN PATENT DOCUMENTS

JP 01-123277 A * 5/1989
JP H07-271255 A 10/1995
JP 08-083031 A * 3/1996
JP 09-050219 A * 2/1997
JP H09-090694 A 4/1997
JP 10-153934 A * 6/1998
JP H11-106073 A 4/1999
JP 11-296041 A * 10/1999
JP 2000-081819 A 3/2000
JP 2002-040894 A * 2/2002

* cited by examiner

*Primary Examiner*—Sophia S. Chen
(74) *Attorney, Agent, or Firm*—Birch, Stewart, Kolasch & Birch, LLP

(57) ABSTRACT

A cleaning unit includes a cabinet, a cleaning blade, a toner drop preventive sheet, and an auxiliary member. The cabinet has an opening facing an outer periphery of a photosensitive drum. The cleaning blade is operative to scrape down residual toner adhering to the outer periphery of the photosensitive drum. The toner drop preventive sheet is operative to prevent the residual toner scraped down by the cleaning blade from dropping between the photosensitive drum and the cabinet. The auxiliary member is disposed below the toner drop preventive sheet and is movable between a first position for receiving a bulk substance dropping from the toner drop preventive sheet and a second position for dropping the bulk substance received from the toner drop preventive sheet.

5 Claims, 7 Drawing Sheets

DRIVER SECTION
70
62
68
64
66
65
65A
65B
31

CLEANING UNIT

CROSS REFERENCE

This Nonprovisional application claims priority under 35 U.S.C. § 119(a) on Patent Application No. 2004-046546 filed in Japan on Feb. 23, 2004, the entire contents of which are hereby incorporated by reference.

BACKGROUND OF THE INVENTION

The present invention relates to cleaning units and, more particularly, to a cleaning unit provided with a toner drop preventive sheet for receiving residual toner scraped down by a cleaning blade.

In an image forming apparatus recording sheets are fed from a sheet feed cassette or a manual feed tray and then transported to an image forming section by means of transport rollers after having been separated one from another by a separating member. During the process of transporting such a recording sheet to the image forming section, short fibers of cellulose for example intertwining with bleaching agent such as $SiO_2$ (kaolin) and other inclusions are separated from the recording sheet as paper powder on the recording sheet by friction between the recording sheet and the separating member. Such paper powder on the recording sheet is attracted to the surface of a photosensitive drum by an electric field generated in the transfer process and then accumulated on a toner drop preventive sheet included in a cleaning unit.

Since such paper powder has a non-uniform distribution of static build-up, accumulation of paper powder on the toner drop preventive sheet exercises an adverse effect on the removal of residual toner on the photosensitive drum by the cleaning unit, thus causing a cleaning failure and a non-uniform distribution of static charge potential over the photosensitive drum.

When accumulated on the toner drop preventive sheet, the aforementioned short fibers intertwine with each other to form paper powder comprising large particles. Since the toner drop preventive sheet has elasticity, such large-particle paper powder acts to deform the toner drop preventive sheet.

Waste toner collected within the cleaning unit is likely to scatter within the image forming apparatus by vibration caused by a feed screw included in the cleaning unit, wind pressure caused by rotation of the photosensitive drum, and other factor. Such scattering waste toner soils not only the interior of the image forming apparatus but also each recording sheet being transported with a toner image transferred thereto. Thus, the quality of the image formed on each recording sheet becomes degraded.

In an attempt to solve the above-described problem, there has been proposed a technique wherein a cleaning roller having a higher coefficient of dynamic friction than any one of the surfaces of respective of a feed roller and a separating member pressed against the feed roller for rotation is pressed against the outer peripheries of respective of the feed roller and the separating member thereby removing paper powder adhering to these outer peripheries, as disclosed in Japanese Patent Application Laid-open No. H11-106073.

Another known technique is such that a cleaning unit for collecting residual toner remaining on the outer periphery of a photosensitive drum is provided with a capture brush which contacts the outer periphery of the photosensitive drum and is operative to remove paper powder adhering to the outer periphery of the photosensitive drum when applied with voltage, as disclosed in Japanese Patent Application Laid-open No. 2000-081819.

With the technique disclosed in the former publication, however, the cleaning roller cannot effectively remove paper powder in a state not electrostatically charged.

With the technique disclosed in the latter publication, the capture brush contacting the outer periphery of the photosensitive drum is applied with a voltage close to a saturation static charge potential of the photosensitive drum. This causes the photosensitive drum to deteriorate while undesirably allowing a trouble to occur in the subsequent image formation.

A feature of the present invention is to provide a cleaning unit which is capable of collecting paper powder from a photosensitive drum while preventing degradation in image quality due to paper powder collected from the photosensitive drum and accumulated in the cleaning unit.

SUMMARY OF THE INVENTION

A cleaning unit according to the present invention includes a cabinet, a cleaning blade, a toner drop preventive sheet, and an auxiliary member. The cabinet is disposed downstream from a transfer position for transferring a toner image from an image carrier to a recording medium along an outer periphery of the image carrier and has an opening facing the outer periphery of the image carrier. Usually, residual toner is collected into the cabinet through the opening. The cleaning blade is operative to scrape down residual toner adhering to the outer periphery of the image carrier when abutting against the outer periphery of the photosensitive drum. The toner drop preventive sheet is operative to prevent the residual toner scraped down by the cleaning blade from dropping between the image carrier and the cabinet. The auxiliary member is disposed below the toner drop preventive sheet and is movable between a first position for receiving a bulk substance dropping from the toner drop preventive sheet and a second position for dropping the bulk substance received from the toner drop preventive sheet.

The foregoing and other features and attendant advantages of the present invention will become more apparent from the reading of the following detailed description of the invention in conjunction with the accompanying drawings.

BRIEF DESCRIPTION OF THE DRAWINGS

FIG. 4A is a front elevational view schematically showing the structure of a separating member in a sheet feed section, while

DETAILED DESCRIPTION OF THE INVENTION

Figure 1:
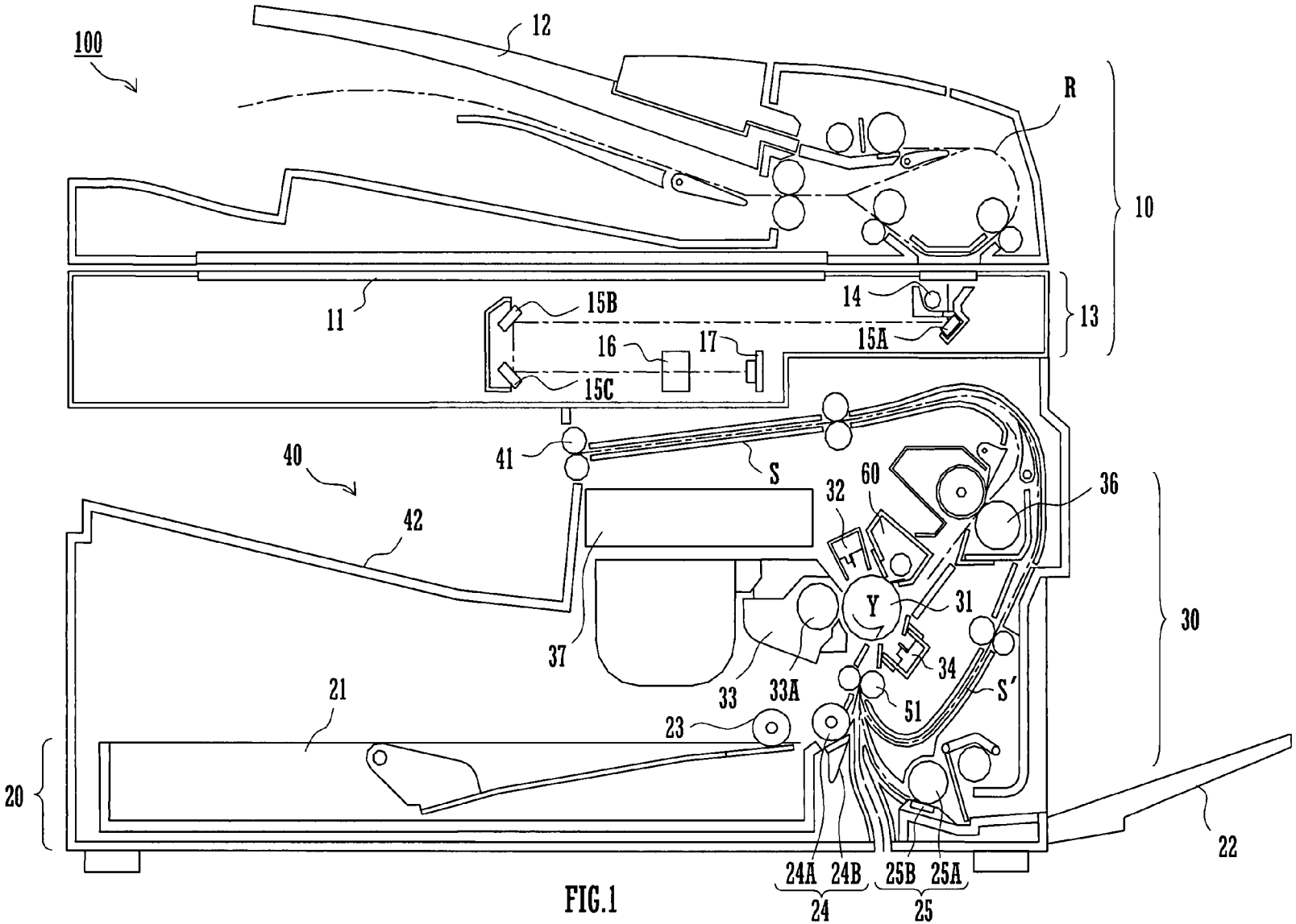
FIG. 1 is a sectional view schematically showing the construction of an image forming apparatus provided with a cleaning unit embodying the present invention.

Hereinafter, the best mode for carrying out the present invention will be described in detail with reference to the accompanying drawings. FIG. 1 is a sectional view schematically showing the construction of an image forming apparatus provided with a cleaning unit embodying the present invention. The image forming apparatus 100 provided with the cleaning unit 60 according to this embodiment has plural modes for forming an image on a recording sheet (equivalent to the recording medium defined by the present invention), including a copier mode, printer mode and FAX mode, any one of which is to be selected by the user. The image forming apparatus 100 is also capable of forming an image through an OHP or the like.

The image forming apparatus 100 includes a document reading section 10, sheet feed section 20, image forming section 30, sheet ejecting section 40, and non-illustrated operating panel and control section. The document reading section 10 includes platen glass 11, document tray 12, and optical scanning system 13. The optical scanning system 13 includes a light source 14, reflecting mirrors 15A to 15C, optical lens 16, and CCD (Charge Coupled Device) 17. The light source 14 illuminates a document placed on the platen glass 11 or a document being transported along a document transport path R. The plural reflecting mirrors 15A to 15C guide reflected light from the document to the optical lens 16. The optical lens 16 condenses reflected light guided by the reflecting mirrors 15A to 15C and guides it to the CCD 17. The CCD 17 reads reflected light thus condensed as image data by photoelectric conversion.

The sheet feed section 20 includes a sheet feed cassette 21, manual feed tray 22, pickup roller 23, and separating members 24 and 25. Recording sheets to be fed to a sheet transport path S during image formation are placed in the sheet feed cassette 21 or the manual feed tray 22. The pickup roller 23 feeds the recording sheets held in the sheet feed cassette 21 to the separating member 24.

The separating members 24 and 25 are structured similarly. The separating member 24 comprises a feed roller 24A and a plate member 24B contacting the outer periphery of the feed roller 24A and the separating member 25 comprises a feed roller 25A and a plate member 25B contacting the outer periphery of the feed roller 25A. The coefficient of friction of the plate member 24B on the side contacting the outer periphery of the feed roller 24A is lower than that of the outer periphery of the feed roller 24A. When the pickup roller 23 feeds plural recording sheets to the separating member 24 at a time, the separating member 24 acts to feed the recording sheets one by one from the recording sheet which is positioned closest to the feed roller 24A side. For example, when two recording sheets are fed from the pickup roller 23 at a time, the separating member 24 feeds first the one which is positioned as contacting the outer periphery of the feed roller 24A to the sheet transport path S by friction between this recording sheet and the feed roller 24A and rotation of the feed roller 24A while stopping the one which is positioned as contacting the plate member 24B at the surface of the plate member 24B by friction between this recording sheet and the plate member 24B.

When plural recording sheets are fed from the manual feed tray 22 to the separating member 25 at a time, the separating member 25 feeds first the one which is positioned closest to the feed roller 25A side.

The image forming section 30 forms an image on a recording sheet through an electrophotographic image forming process. The image forming section 30 is located below the document reading section 10. The image forming section 30 includes a laser scanning unit (hereinafter will be referred to as LSU) 37, photosensitive drum 31, fixing device 36, and the like. The photosensitive drum 31 rotates counterclockwise (in the direction indicated by arrow Y.) Around the photosensitive drum 31 are disposed a static charger 32, developing device 33, transfer device 34 and cleaning unit 60 in this order along the direction of rotation of the photosensitive drum 31.

The sheet ejecting section 40, which is located above the sheet feed cassette 21, includes sheet ejecting rollers 41 and an ejected sheet tray 42. The sheet ejecting rollers 41 eject each recording sheet fed thereto along the sheet transport path S. The sheet ejecting rollers 41 are forwardly and backwardly rotatable. In forming images on both sides of a recording sheet the ejecting rollers 41 chuck a recording sheet that has been fed thereto along the sheet transport path S as bearing an image formed on the observe side thereof and then rotate in the direction opposite to the direction in which each recording sheet is to be ejected toward the ejected sheet tray 42 thereby to feed the recording sheet to a sheet transport path S'. Thus, the recording sheet is turned upside down and the reverse side of the recording sheet comes to face the photosensitive drum 31 for a toner image to be transferred thereto. The ejected sheet tray 42 receives each recording sheet bearing a toner image thereon and ejected by the sheet ejecting rollers 41. In this embodiment the pickup roller 23 and the separating members 24 and 25 are each positioned centrally of the sheet transport path in a direction perpendicular to an associated sheet transport direction. The control section includes a CPU, ROM having a predetermined program stored therein, RAM serving as a working area of the CPU, predetermined driver, and other components. The control section is constantly fed with timing information on the image forming process for controlling the whole operation of the image forming apparatus 100.

In forming the image of a document on a recording sheet in the copier mode the user places the document on the platen glass 11 or document tray 12 of the document reading section 10, depresses input keys of the operating panel to input desired settings including the number of copies to be printed and a print magnification, and then depresses a start key to start the copying operation.

When the start key is depressed, a recording sheet is fed to the sheet transport path S by rotation of the pickup roller 23 of the image forming apparatus 100 and then transported to registration rollers 51.

The registration rollers 51 chuck the leading edge of the recording sheet so that the leading edge is oriented parallel with the axis of the registration rollers 51 for registration with the leading edge of a toner image formed on the outer periphery of the photosensitive drum 31.

Image data read by the document reading section 10 is subjected to image processing based on the settings inputted from the operating panel and then transmitted as print data to the LSU 37. The outer periphery of the photosensitive drum 31 is electrostatically charged to a predetermined potential by the static charger 32. The LSU 37 irradiates the outer periphery of the photosensitive drum 31 with laser light according to the aforementioned image data through non-illustrated polygon mirror and various lenses to form an electrostatic latent image on the outer periphery of the photosensitive drum 31. Subsequently, toner adhering to the surface of an MG roller 33A of the developing device 33 is attracted onto the outer periphery of the photosensitive drum 31 in accordance with the potential gap on the outer periphery of the photosensitive drum 31, thereby rendering the electrostatic latent image visible.

In turn, the registration rollers 51 rotate with such timing as to register the recording sheet chucked thereby with the toner image formed on the outer periphery of the photosensitive drum 31 to feed the recording sheet to the space defined between the photosensitive drum 31 and the transfer device 34. Subsequently, the transfer device 34 transfers the toner image carried on the outer periphery of the photosensitive drum 31 to the recording sheet. The toner image thus transferred to the recording sheet is then fused by heat and pressure applied by the fixing device 36 and fixed to the recording sheet. The recording sheet bearing the toner image thus fixed thereto is ejected onto the ejected sheet tray 42 by the sheet ejecting rollers 41.

The cleaning unit 60 collects residual toner, paper powder and the like remaining on the outer periphery of the photosensitive drum 31 from which the toner image has already been transferred to the recording sheet.

Figure 2:
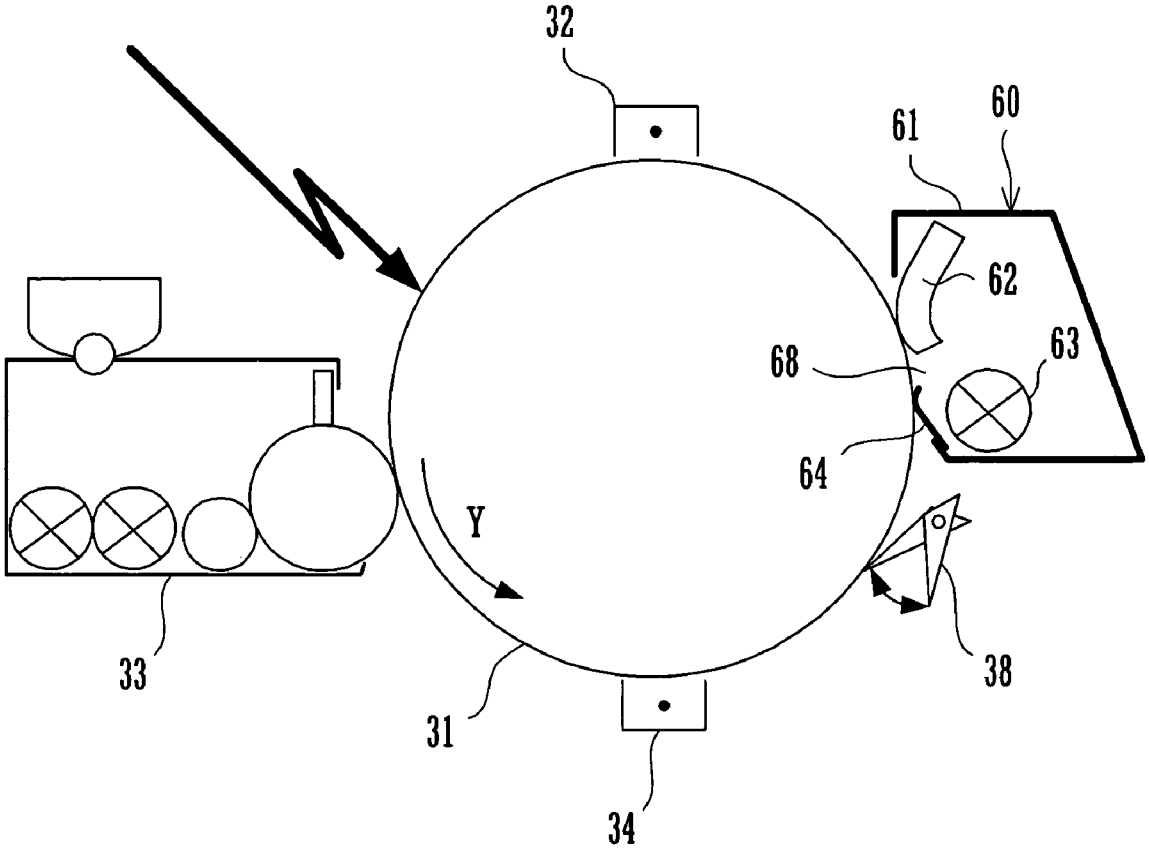
FIG. 2 is an enlarged view showing a portion of concern of an image forming section included in the image forming apparatus.

FIG. 2 is an enlarged view showing a portion of concern of the image forming section 30. The cleaning unit 60 includes a cabinet 61, cleaning blade 62, feed screw 63, toner drop preventive sheet 64, auxiliary member 65 (see FIG. 3), driver section 70 configured to move the auxiliary member 65, and other components. The cabinet 61 is disposed so that opening 68 thereof faces the outer periphery of the photosensitive drum 31.

The cleaning blade 62 has one end secured to a portion adjacent an upper edge of the opening 68 and an opposite end abutting against the outer periphery of the photosensitive drum 31 at a predetermined pressure. The cleaning blade 62 scrapes down residual toner and paper powder adhering to the outer periphery of the photosensitive drum 31 with rotation of the photosensitive drum 31.

The residual toner and paper powder scraped down from the outer periphery of the photosensitive drum 31 by the cleaning blade 62 are received by the toner drop preventive sheet 64 and then guided into the cabinet 61.

The feed screw 63 is rotatably mounted within the cabinet 61. The feed screw 63 feeds the toner and paper powder guided into the cabinet 61 to a non-illustrated collected toner storage box.

The toner drop preventive sheet 64 comprises a resin film having an electrostatic property which is opposite in polarity to that of toner. The toner drop preventive sheet 64 has one end secured to a portion adjacent a lower edge of the opening 68 by means of a sheet fitting member 66 (see FIG. 3) and an opposite end contacting the outer periphery of the photosensitive drum 31. The toner drop preventive sheet 64 receives residual toner and paper powder scraped down from the outer periphery of the photosensitive drum 31 by the cleaning blade 62, thereby preventing the toner and paper powder from dropping out of the cleaning unit 60 and leaking out of the cabinet 61.

Sheet peel nails 38 are disposed upstream of the cleaning unit 60 and downstream of the transfer device 34 along the outer periphery of the photosensitive drum 31. The sheet peel nails 38 peel off each recording sheet bearing a toner image that has been transferred thereto at the position where the transfer device 34 and the photosensitive drum 31 face each other from the photosensitive drum 31.

Here, residual toner and paper powder electrically adhering to the outer periphery of the photosensitive drum 31 are attracted to the toner drop preventive sheet 64 by electrostatic force since the toner drop preventive sheet 64 comprises the resin sheet having the electrostatic property opposite in polarity to that of toner. For this reason such residual toner and paper powder can be removed easily from the photosensitive drum 31. Further, the toner drop preventive sheet 64 comprising the resin film will not damage the outer periphery of the photosensitive drum 31 even though it contacts the outer periphery of the photosensitive drum 31. Preferably, the toner drop preventive sheet 64 has a thickness ranging from 0.01 mm to 0.05 mm. If the thickness of the toner drop preventive sheet 64 is more than 0.05 mm, the toner drop preventive sheet 64 is likely to damage the outer periphery of the photosensitive drum 31. If the thickness of the toner drop preventive sheet 64 is less than 0.01 mm, on the other hand, it is difficult for the toner drop preventive sheet 64 to maintain its predetermined shape.

Figure 3:
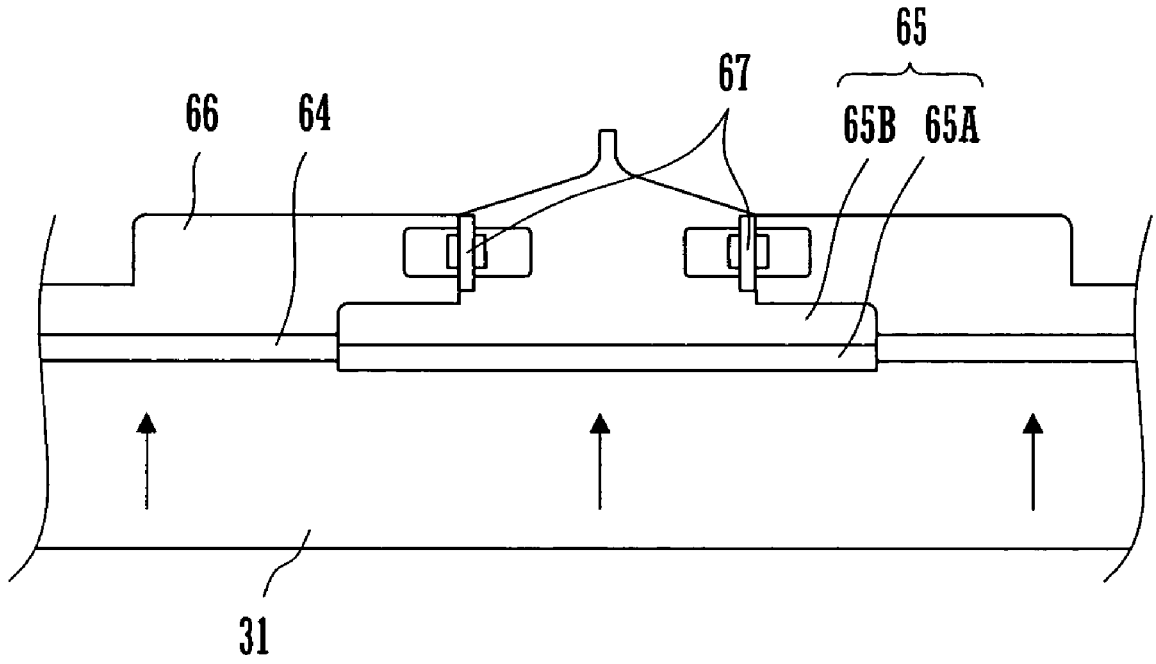
FIG. 3 is a view schematically showing the structure of an auxiliary member.

FIG. 3 is a view schematically showing the structure of the auxiliary member 65. The auxiliary member 65 is disposed below the toner drop preventive sheet 64 so as to coincide with a substantially central portion of the photosensitive drum 31 in terms of the axis of the photosensitive drum 31 (i.e., in the primary scanning direction). The auxiliary member 65 comprises a sheet member 65A and a sheet fitting member 65B. In a direction perpendicular to the axis of the photosensitive drum 31 the sheet member 65A has one end secured to the sheet fitting member 65B and an opposite end contacting the outer periphery of the photosensitive drum 31.

The sheet fitting member 65B has supports 67 pivotally supported on the sheet fixing member 66. The auxiliary member 65 is movable between a first position shown in FIG. 7A and a second position shown in FIG. 7B.

When the auxiliary member 65 is in the first position, the sheet member 65A is ready to receive a bulk substance (comprising residual toner and paper powder) dropping from the toner drop preventive sheet 64 at a position adjacent the rear side of the toner drop preventive sheet 64 (on the upstream side along the outer periphery of the photosensitive drum 31.)

When the auxiliary member 65 is in the second position, the sheet member 65A becomes supported on only one side because the end having been in contact with the photosensitive drum 31 becomes spaced apart from the photosensitive drum 31 obliquely downwardly. When the sheet member 65A moves away from the toner drop preventive sheet 64 and from the photosensitive drum 31, an inertia force works on the bulk substance on the sheet member 65A. Further, vibration generated by the feed screw 63 is transmitted to the sheet member 65A. For these reasons the bulk substance received from the toner drop preventive sheet 64 by the sheet member 65A is allowed to drop when the auxiliary member 65 is in the second position.

The auxiliary member 65 is constantly biased toward the toner drop preventive sheet 64 by a spring for example and can be stopped in the first position when engaged by a stopper for example. The auxiliary member 65 can be moved to the second position temporarily by a solenoid. The driver section 70 drives the solenoid based on timing information on the image forming process to cause the auxiliary member 65 to move to the second position. When the driver 70 stops driving the solenoid based on the timing information, the auxiliary member 65 is moved to the first position by the force of the spring.

Figure 4A:
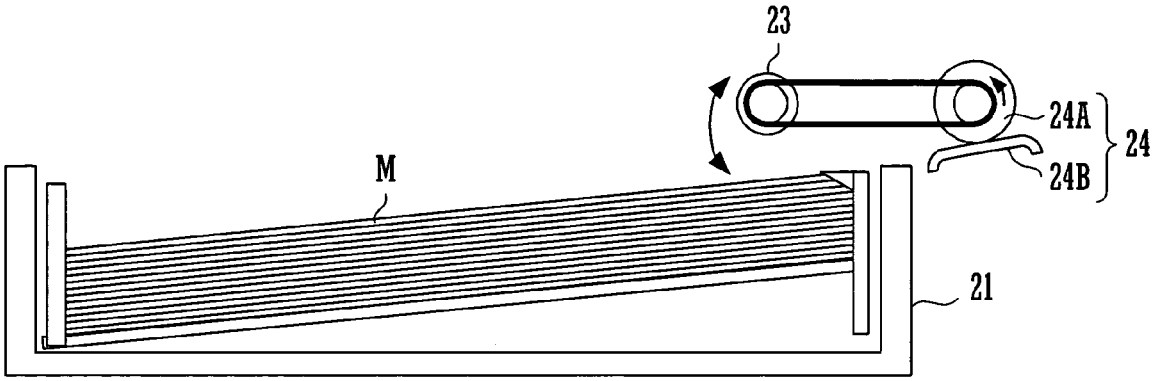
Figure 4B:
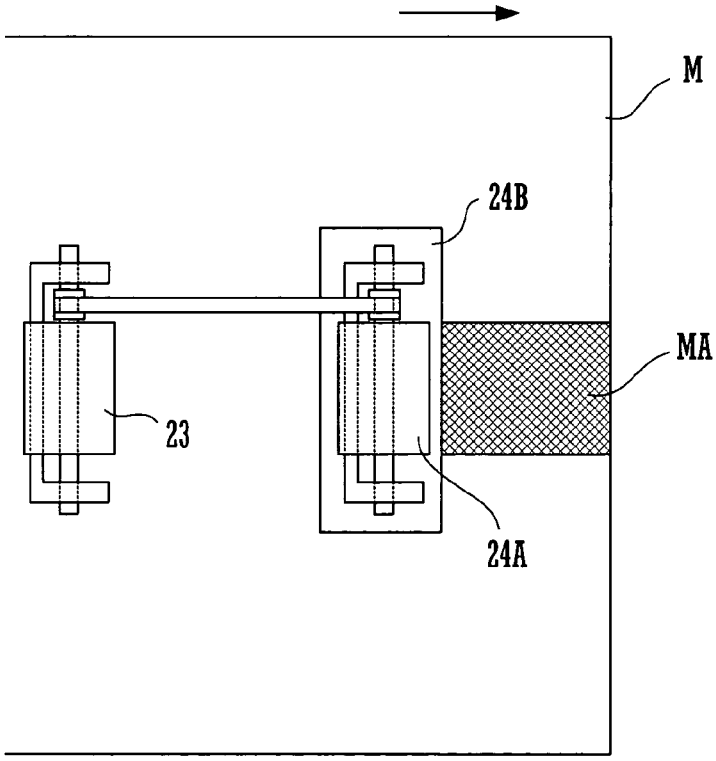
FIG. 4B is a plan view schematically showing the structure of the separating member.

FIG. 4A is a front elevational view schematically showing the structure of the separating member 24 in the sheet feed section 20, while FIG. 4B is a plan view schematically showing the structure of the separating member 24.

The pickup roller 23 feeds recording sheets M to the separating member 24 which in turn separates the recording sheets M one from another by frictional forces generated between the recording sheets M and the feed roller 24A of the separating member 24 and between the recording sheets M and the plate member 24B of the separating member 24. Thereafter, each recording sheet M is fed to the sheet transport path S.

Here, paper powder is produced from each recording sheet M by the friction of the recording sheet M with the feed roller 24A and with the plate member 24B during separation of the recording sheets M one from another. In the present embodiment the separating member 24 is configured to contact a substantially central portion of each recording sheet M in the primary scanning direction and, hence, paper powder is apt to be produced from the substantially central portion MA of each recording sheet M in the primary scanning direction.

Figure 5:
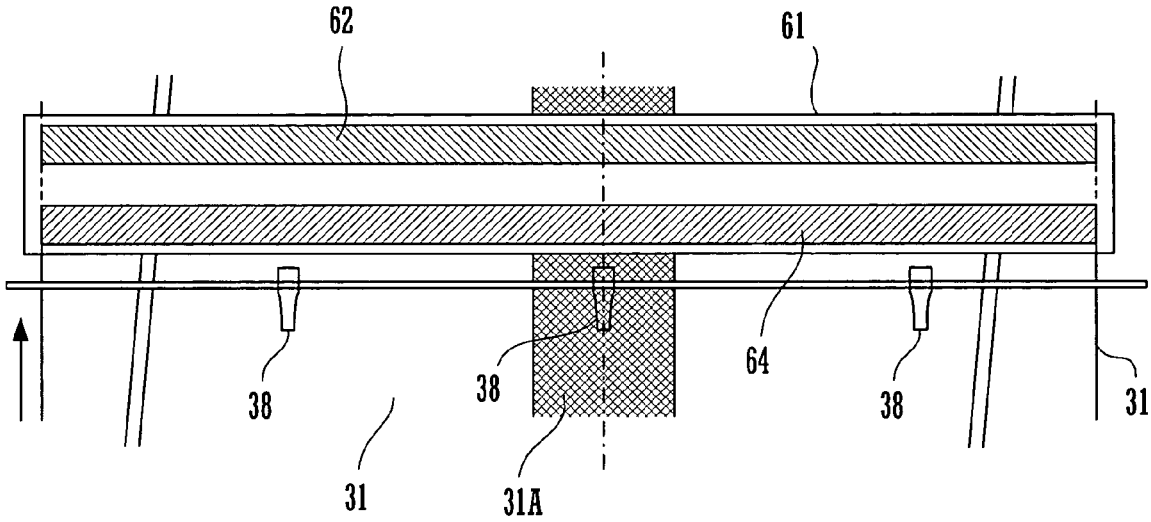
FIG. 5 is a side elevational view showing a photosensitive drum and the cleaning unit.

FIG. 5 is a side elevational view showing the photosensitive drum 31 and the cleaning unit 60. Paper powder becomes electrostatically charged by friction with non-illustrated transport rollers and other components during transport of each recording sheet M. For this reason such paper powder adheres to the outer periphery of the photosensitive drum 31 when a toner image carried on the outer periphery of the photosensitive drum 31 is transferred to recording sheet M. Since paper powder is apt to be produced from the substantially central portion MA of each recording sheet M in the primary scanning direction as described above, a large amount of paper powder adheres to a substantially central portion 31A of the outer periphery of the photosensitive drum 31 in terms of the axis of the photosensitive drum 31 (i.e., in the primary scanning direction.)

Figure 6:
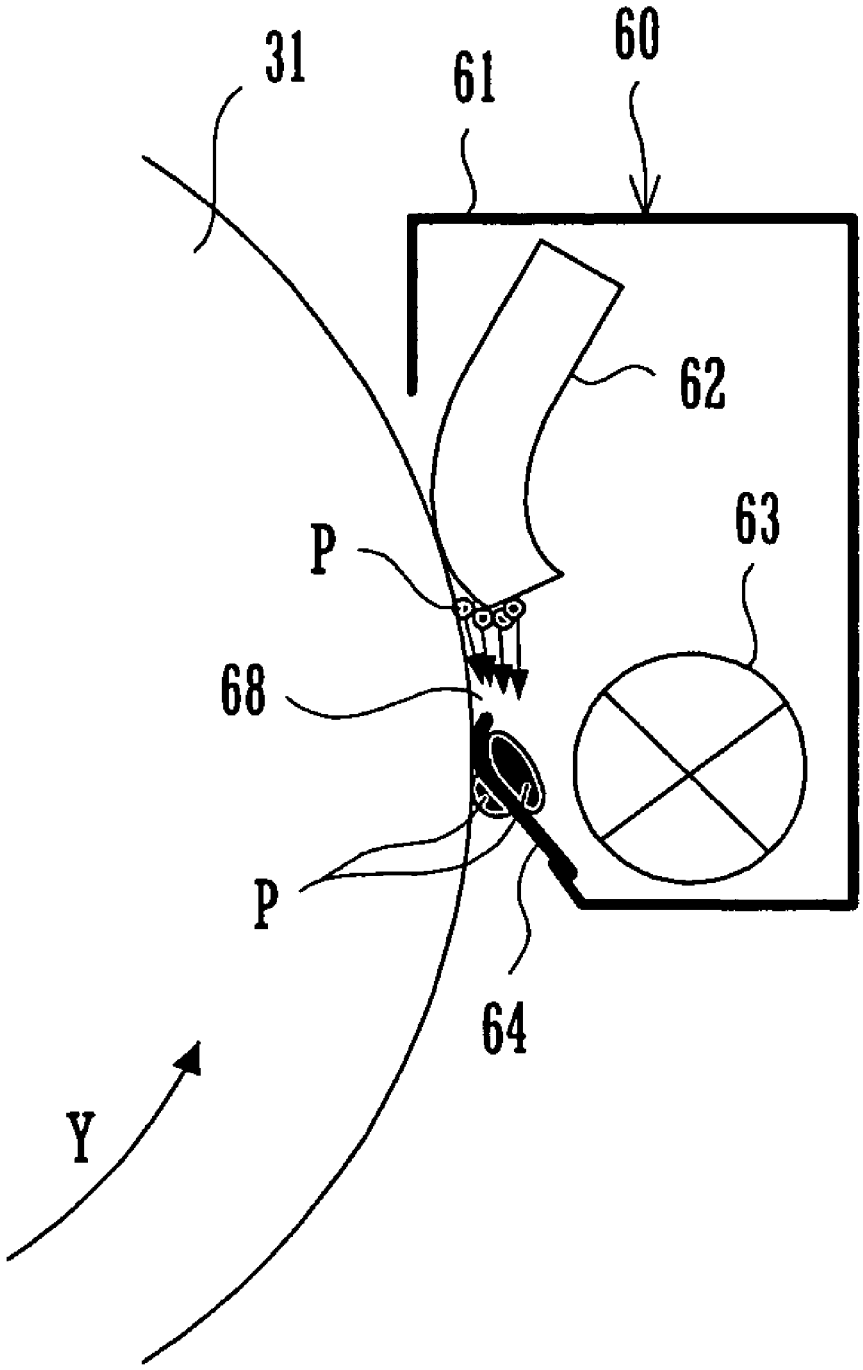
FIG. 6 is an enlarged view showing a portion of concern of the image forming section.

FIG. 6 is an enlarged view showing a portion of concern of the image forming section 30. Residual toner and paper powder P adhering to the outer periphery of the photosensitive drum 31 are scraped down by the cleaning blade 62 of the cleaning unit 60 and then received by the toner drop preventive sheet 64. Paper powder P thus scraped down by the cleaning blade 62 is likely to accumulate on the toner drop preventive sheet 64 because paper powder P has low fluidity. Owing to the toner drop preventive sheet 64 contacting the outer periphery of the photosensitive drum 31, it is possible that paper powder P adhering to the photosensitive drum 31 accumulates directly on a portion of the toner drop preventive sheet 64 contacting the outer periphery of the photosensitive drum 31 and an area therearound.

In the present embodiment a large amount of paper powder P is likely to adhere to the substantially central portion 31A of the outer periphery of the photosensitive drum 31 in terms of the axis of the photosensitive drum 31 (i.e., in the primary scanning direction.) For this reason paper powder P is likely to accumulate and grow into a large bulk on a substantially central portion of the toner drop preventive sheet 64. When a large bulk of paper powder P is formed, it is likely that paper powder P drops together with toner from the toner drop preventive sheet 64 due to vibration generated by the feed screw 63 in the cleaning unit 60 and other factors. In the cleaning unit 60 a bulk comprising paper powder P and toner dropping from the toner drop preventive sheet 64 is received by the auxiliary member 65.

Figures 7A, 7B, 7C, 7D:
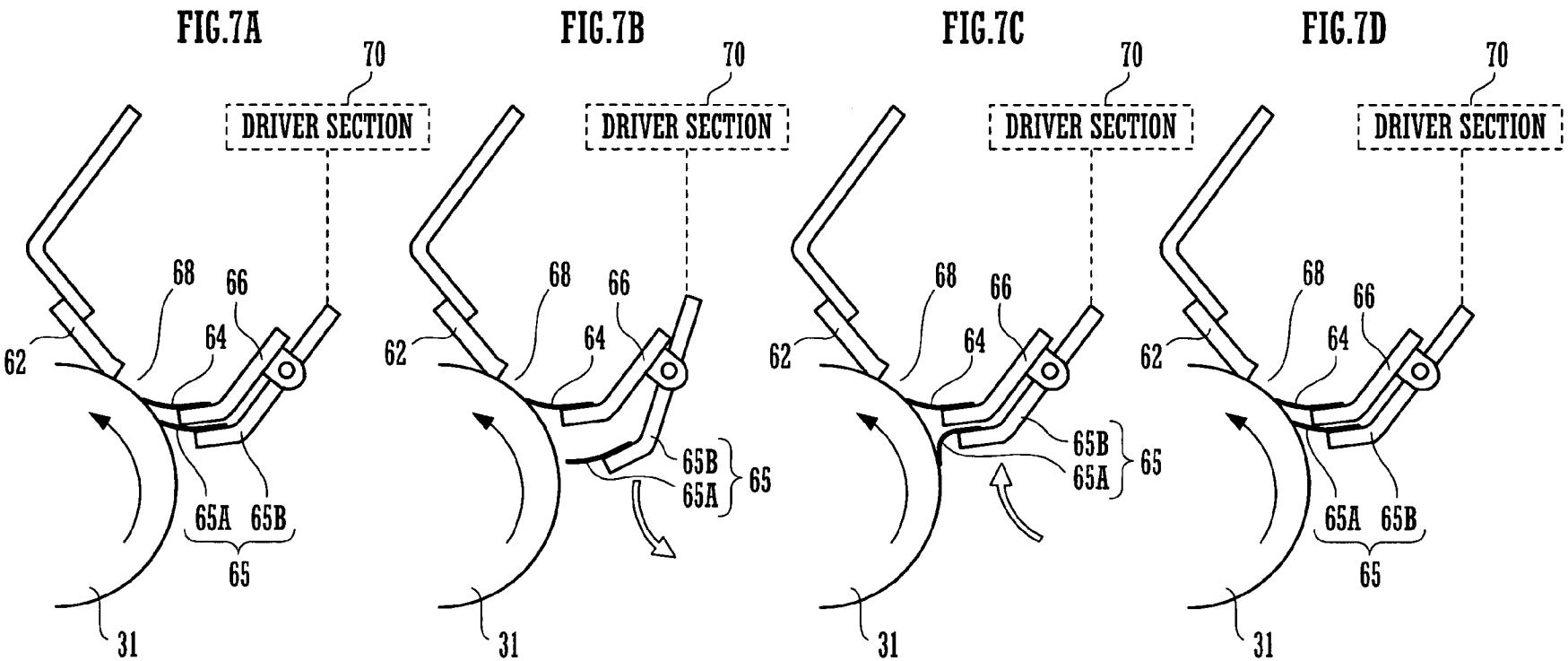
FIG. 7A is a view illustrating the auxiliary member in a first position.
FIG. 7B is a view illustrating the auxiliary member in a second position.
FIG. 7C is a view illustrating the auxiliary member in a state just after having moved from the second position to the first position.
FIG. 7D is a view illustrating the auxiliary member in a state changed from the state illustrated in FIG. 7C after lapse of a predetermined time.

FIGS. 7A to 7D illustrate different states of the auxiliary member 65. Usually, the auxiliary member 65 is in the first position as shown in FIG. 7A. The sheet member 65A of the auxiliary member 65 is located upstream from the toner preventive drop sheet 64 along the outer periphery of the photosensitive drum 31, or below the toner drop preventive sheet 64. This arrangement enables the sheet member 65A to receive a bulk comprising paper powder P and toner when the bulk drops from the toner drop preventive sheet 64 and hence prevents such a bulk from adhering to recording sheet M being transported. Accordingly, each recording sheet M is prevented from being soiled due to scattering of paper powder P and toner, which results in the quality of an image on each recording sheet M being prevented from degrading. The auxiliary member 65 assumes the first position even during halts of the image forming apparatus 100. For this reason, even when the image forming apparatus 100 is tilted or vibrated during transportation, toner and paper powder P in the cleaning unit 60 can be prevented from dropping out of the cleaning unit 60.

During rotation of the photosensitive drum 31 the driver section 70 moves the auxiliary member 65 to the second position temporarily as shown in FIG. 7B at any time within a period from passage of the trailing edge of a residual toner image on the outer periphery of the photosensitive drum 31 through the position of contact between the cleaning blade 62 and the photosensitive drum 31 to arrival of the leading edge of a subsequent toner image at the position of contact, and then returns the auxiliary member 65 to the first position as shown in FIG. 7C.

The sheet member 65A of the auxiliary member 65 becomes warped in the direction opposite to the direction of rotation of the photosensitive drum 31 as shown in FIG. 7C at the time just after the sheet member 65A has been returned from the second position to the first position. Thereafter, however, the sheet member 65A is deformed by the frictional force generated between the sheet member 65A and the outer periphery of the photosensitive drum 31 rotating as shown in FIG. 7D, so that the warped state of the sheet member 65A is corrected. Thus, the sheet member 65A becomes abutted against the outer periphery of the photosensitive drum 31 as oriented forwardly in the direction of rotation of the photosensitive drum 31 to receive bulk substances dropping from the toner drop preventive sheet 64.

A toner image carried on the outer periphery of the photosensitive drum 31 is transferred to recording sheet M passing between the photosensitive drum 31 and the transfer device 34. Recording sheet M is present below the cleaning unit 60 during passage of the residual toner image on the outer periphery of the photosensitive drum 31 through the position of contact between the photosensitive drum 31 and the cleaning blade 62. On the other hand, during the period from the passage of the trailing edge of the residual toner image on the outer periphery of the photosensitive drum 31 through the position of contact between the cleaning blade 62 and the photosensitive drum 31 to the arrival of the leading edge of the subsequent toner image at the position of contact, recording sheet M is absent below the cleaning unit 60.

For this reason, the driver section 70 moves the auxiliary member 65 to the second position temporarily at any time within the period from the passage of the trailing edge of the residual toner image on the outer periphery of the photosensitive drum 31 through the position of contact between the cleaning blade 62 and the photosensitive drum 31 to the arrival of the leading edge of the subsequent toner image at the position of contact. Thus, during the presence of recording sheet M below the cleaning unit 60, the auxiliary member 65 prevents paper powder P and the like from dropping. During the absence of recording sheet M below the cleaning unit 60, on the other hand, the auxiliary member 65 allows paper powder P and the like received from the toner drop preventive sheet 64 to drop due to vibration generated by the feed screw 63 and other factors without soiling recording sheet M. In this way a bulk comprising paper powder P and the like received from the toner drop preventive sheet 64 and accumulated on the sheet member 65A can be removed without soiling recording sheet M.

The driver section 70 may move the auxiliary member 65 from the first position to the second position with the following timing other than the above-described timing.

That is, during rotation of the photosensitive drum 31 the driver section 70 may move the auxiliary member 65 from the first position to the second position temporarily at any time within a period between a first job of forming an image on at least one recording sheet M and a second job of forming an image on at least one recording sheet M after the first job.

Alternatively, the driver section 70 may move the auxiliary member 65 from the first position to the second position temporarily at any time during rotation of the photosensitive drum 31 after completion of an image forming operation, that is, during post-processing after completion of image formation, including elimination of residual potential of the photosensitive drum 31 and removal of residual toner.

By temporarily moving the auxiliary member 65 to the second position with the above-described timing, a bulk comprising paper powder P and the like received from the toner drop preventive sheet 64 can be removed from the auxiliary member 65 without soiling and damaging recording sheet M bearing an toner image transferred thereto. Thus, the quality of the image formed on the recording sheet M can be prevented from degrading.

Once the auxiliary member 65 has been moved to the second position with the above-described timing, a bulk comprising paper powder P and the like accumulated on the toner drop preventive sheet 64 is also dropped due to vibration generated by the feed screw 63 and other factors without being received by the auxiliary member 65. Therefore, paper powder P and the like can be removed from the toner drop preventive sheet 64 without soiling and damaging recording sheet M.

The length of time after the driver section 70 has moved the auxiliary member 65 to the second position until the driver section 70 returns it to the first position can be established as desired based on the results of experiments and the like as long as the established length of time is within the above-described range of timing.

It is likely that a large amount of paper powder P accumulates on the substantially central portion of the toner drop preventive sheet 64 in the primary scanning direction as described above. For this reason, if transport rollers that have to be disposed below the cleaning unit 60 are positioned on opposite sides of the sheet transport path in the direction perpendicular to the sheet transport direction for example, the transport rollers will not be soiled or damaged by dropping paper powder P and the like and, hence, recording sheet M subsequently transported below the cleaning unit 60 can be prevented from being soiled and damaged.

The foregoing embodiment should be construed to be illustrative and not limitative of the present invention in all the points. The scope of the present invention is defined by the following claims, not by the foregoing embodiment. Further, it is intended that the scope of the present invention include the scopes of the claims and all the possible changes and modifications within the sense and scope of equivalents.

What is claimed is:

1. A cleaning unit comprising:

a cabinet disposed downstream from a transfer position for transferring a toner image from an image carrier to a recording medium along an outer periphery of the image carrier and having an opening facing the outer periphery of the image carrier;

a cleaning blade operative to scrape down residual toner adhering to the outer periphery of the image carrier when abutting against the outer periphery of the image carrier;

a toner drop preventive sheet disposed below the cleaning blade and operative to prevent the residual toner scraped down by the cleaning blade from dropping between the image carrier and the cabinet;

an auxiliary member disposed below the toner drop preventive sheet, the auxiliary member being movable between a first position for receiving a bulk substance dropping from the toner drop preventive sheet and a second position for dropping the bulk substance received from the toner drop preventive; and a driver section configured to move the auxiliary member between the first position and the second position during normal operation of transferring a toner image from the image carrier to a recording medium.

2. The cleaning unit according to claim 1, wherein the auxiliary member has a sheet member capable of contacting the image carrier, the sheet member having an elasticity to allow the sheet member to deform by a frictional force generated between the sheet member and the image carrier rotating.

3. A cleaning unit comprising:

a cabinet disposed downstream from a transfer position for transferring a toner image from an image carrier to a recording medium along an outer periphery of the image carrier and having an opening facing the outer periphery of the image carrier;

a cleaning blade operative to scrape down residual toner adhering to the outer periphery of the image carrier when abutting against the outer periphery of the image carrier;

a toner drop preventive sheet disposed below the cleaning blade and operative to prevent the residual toner scraped down by the cleaning blade from dropping between the image carrier and the cabinet;

an auxiliary member disposed below the toner drop preventive sheet, the auxiliary member being movable between a first position for receiving a bulk substance dropping from the toner drop preventive sheet and a second position for dropping the bulk substance received from the toner drop preventive sheet; and a driver section configured to move the auxiliary member between the first position and the second position, wherein during rotation of the image carrier the driver section is operative to move the auxiliary member to the second position at any time within a period from passage of a trailing edge of a residual toner image on the outer periphery of the image carrier through a position of contact between the cleaning blade and the image carrier to arrival of a leading edge of a subsequent toner image at the position of contact.

4. A cleaning unit comprising:

a cabinet disposed downstream from a transfer position for transferring a toner image from an image carrier to a recording medium along an outer periphery of the image carrier and having an opening facing the outer periphery of the image carrier;

a cleaning blade operative to scrape down residual toner adhering to the outer periphery of the image carrier when abutting against the outer periphery of the image carrier;

a toner drop preventive sheet disposed below the cleaning blade and operative to prevent the residual toner scraped down by the cleaning blade from dropping between the image carrier and the cabinet;

an auxiliary member disposed below the toner drop preventive sheet, the auxiliary member being movable between a first position for receiving a bulk substance dropping from the toner drop preventive sheet and a second position for dropping the bulk substance received from the toner drop preventive sheet; and a driver section configured to move the auxiliary member between the first position and the second position, wherein during rotation of the image carrier the driver section is operative to move the auxiliary member to the second position at any time within a period between a first job of forming an image on at least one recording sheet and a second job of forming an image on at least one recording sheet after the first job.

5. A cleaning unit comprising:

a cabinet disposed downstream from a transfer position for transferring a toner image from an image carrier to a recording medium alone an outer periphery of the image carrier and having an opening facing the outer periphery of the image carrier;

a cleaning blade operative to scrape down residual toner adhering to the outer periphery of the image carrier when abutting against the outer periphery of the image carrier;

a toner drop preventive sheet disposed below the cleaning blade and operative to prevent the residual toner scraped down by the cleaning blade from dropping between the image carrier and the cabinet;

an auxiliary member disposed below the toner drop preventive sheet, the auxiliary member being movable between a first position for receiving a bulk substance dropping from the toner drop preventive sheet and a second position for dropping the bulk substance received from the toner drop preventive sheet; and a driver section configured to move the auxiliary member between the first position and the second position, wherein the driver section is operative to move the auxiliary member to the second position at any time during rotation of the image carrier after completion of an image forming operation.

* * * * *